US006470841B2

(12) United States Patent
Takahashi et al.

(10) Patent No.: US 6,470,841 B2
(45) Date of Patent: Oct. 29, 2002

(54) VALVE OPERATING SYSTEM FOR INTERNAL COMBUSTION ENGINES

(75) Inventors: Atsushi Takahashi, Toyama (JP); Takaaki Harasaki, Toyama (JP); Masayasu Tajima, Toyama (JP); Chikara Tanaka, Wako (JP); Takeya Harada, Wako (JP); Noriyuki Yamada, Wako (JP)

(73) Assignees: Tanaka Seimitsu Kogyo Co., Ltd., Toyama (JP); Honda Giken Kogyo Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/963,794

(22) Filed: Sep. 27, 2001

(65) Prior Publication Data

US 2002/0053329 A1 May 9, 2002

(30) Foreign Application Priority Data

Oct. 4, 2000 (JP) ..... 2000-304494

(51) Int. Cl.[7] ..... F01M 1/06

(52) U.S. Cl. ..... 123/90.33; 123/90.12; 123/90.16; 123/90.39

(58) Field of Search ..... 123/90.16, 90.25, 123/90.33, 90.36, 90.39, 90.43

(56) References Cited

U.S. PATENT DOCUMENTS 5,845,614 A * 12/1998 Tanaka et al. ..... 123/90.16
5,960,754 A * 10/1999 Sugimoto et al. ..... 123/90.15
6,125,805 A * 10/2000 Sato et al. ..... 123/90.16
6,186,102 B1 * 2/2001 Kosuge et al. ..... 123/90.16
6,318,315 B1 * 11/2001 Harada et al. ..... 123/90.15
6,330,869 B1 * 12/2001 Yoshiki et al. ..... 123/90.15

FOREIGN PATENT DOCUMENTS

JP 11-013442 1/1999

* cited by examiner

*Primary Examiner*—Thomas Denion
*Assistant Examiner*—Ching Chang
(74) *Attorney, Agent, or Firm*—Armstrong, Westerman & Hattori, LLP

(57) ABSTRACT

The present invention provides a valve operating system for internal combustion engines, having a roller rolling contacting a valve operating cam, the system being provided with an oil supply passage capable of reducing a pressure loss to a low level even when a flow rate of lubricating oil entering the oil supply passage increases in accordance with a heightened engine speed, improving the lubricating ability with respect to the roller, and attaining a long lifetime of a rocker arm. This valve operating system includes a rocker arm support member provided with an oil passage in an inner portion thereof, a cam shaft provided on a valve operating cam, and a rocker arm which is provided with a roller rolling contacting the valve operating cam, and which is provided in an inner portion thereof with an oil supply passage for supplying a lubricating oil from the rocker arm support member to the roller, the sectional area of the flow passage of the oil supply passage increasing gradually from an opening thereof on the side of the roller toward an opening thereof on the side of the rocker arm support member.

8 Claims, 7 Drawing Sheets

VALVE OPERATING SYSTEM FOR INTERNAL COMBUSTION ENGINES

BACKGROUND OF THE INVENTION

1. Field of the Invention

This invention relates to a valve operating system for internal combustion engines, having a roller rolling contacting a valve-operating cam.

2. Description of the Prior Art

Such a valve operating system for internal combustion engines has already been known from Japanese Patent Laid-Open No. 13442/1999 and so on.

The known valve operating systems of this kind include a valve operating system disclosed in Japanese Patent Laid-Open No. 13442/1999. This is a roller-carrying rocker arm provided with an oil supply passage for supplying lubricating oil to a roller. However, with the development of a higher-revolution engine, a more sufficient lubrication of a roller has been demanded. Hitherto, the oil supply passage has been formed in a straight form by drilling. Therefore, in order to enlarge an oil supply port for the purpose of increasing an oil supply rate, it has also been necessary that the diameter of an oil supply passage be increased in accordance with the enlarged oil supply port. This causes a rocker arm to be enlarged, and in its return the internal combustion engine to be also enlarged. In the known valve operating system, a roller shaft has been fitted in a contacting state in a bottomed portion-carrying engagement bore of the rocker arm, so that it has been difficult to supply lubricating oil to the portion of a roller which is the most distant from a rocker arm supporting wall portion.

SUMMARY OF THE INVENTION

The present invention has been made in view of the above-mentioned circumstances, and provides a rocker arm which solves the above-mentioned problems encountered in the known art roller-carrying rocker arm, and which has a high lubricating ability with respect to a roller, a high durability and a long lifetime.

The inventors of the present invention have assiduously studied so as to attain the objects above, and, as a result, have unexpectedly found improved techniques concerning the valve operating system of this kind. A valve operating system for internal combustion engines of our present invention has a rocker arm support member provided with an oil passage in an inner portion thereof, a cam shaft provided on a valve operating cam, and an oil supply passage which is provided in the rocker arm having a roller contacting the valve operating cam while the cam's rolling, and which is used to supply lubricating oil from the rocker arm support member to the roller, in which system a sectional area of a flow passage of the oil supply passage is increased gradually from an opening thereof on the side of the roller toward an opening thereof on the side of the rocker arm support member.

The inventors of the present invention have also surprisingly discovered the additional techniques capable of ideally improving the lubricating ability of the system of this kind with respect to the mentioned roller. A valve operating system for internal combustion engines which utilizes these techniques has a rocker arm support member provided with an oil passage in an inner portion thereof, a cam shaft provided with a valve operating cam thereon, a roller shaft provided on an outer circumference thereof with a roller contacting the cam while the cam's rolling via a needle bearing, and a rocker arm provided with first and second support wall portions mutually separated each other with a space and opposed to each other, the first support wall portion being provided with a bottomed portion-carrying engagement bore, the roller shaft being inserted in the engagement bore, the rocker arm in the engagement bore being provided therein with an oil supply passage for supplying lubricating oil from the rocker arm support member to the engagement bore, the system including a clearance provided between the end portion of the roller shaft which is most distant from the rocker arm support member and the bottomed portion.

Moreover, the rocker arm can be manufactured industrially with ease by using a well known method, for example, a lost wax process, the MIM process or die casting and so on.

The present invention relates to a valve operating system for internal combustion engines, having a roller rolling contacting a valve operating cam, the system being provided with an oil supply passage capable of reducing a pressure loss to a low level even when a flow rate of lubricating oil entering the oil supply passage increases in accordance with a heightened engine speed, improving the lubricating ability with respect to the roller, and attaining a long lifetime of a rocker arm. This valve operating system includes a rocker arm support member provided with an oil passage in an inner portion thereof, a cam shaft provided on a valve operating cam, and a rocker arm which is provided with a roller rolling contacting the valve operating cam, and which is provided in an inner portion thereof with an oil supply passage for supplying lubricating oil from the rocker arm support member to the roller, the sectional area of the flow passage of the oil supply passage increasing gradually from an opening thereof on the side of the roller toward an opening thereof on the side of the rocker arm support member.

More concretely to say:

(1) According to an aspect of the present invention, the present invention provides the valve operating system for internal combustion engines comprising a rocker arm support member provided with an oil passage in an inner portion thereof, a cam shaft provided with a valve operating cam thereon, and a rocker arm which is provided thereon with a roller contacting the valve operating cam while the cam's rolling, and which is provided in an inner portion thereof with an oil supply passage for supplying a lubricating oil from the rocker arm support member to the roller, wherein the valve operating system is characterized by that the sectional area of a flow passage of the oil supply passage increases gradually from an opening thereof on the side of the roller toward an opening thereof on the side of the rocker arm support member.

(2) According to another aspect of the present invention, the present invention provides a valve operating system for internal combustion engines in accordance with the first invention (1) above, in which the oil supply passage extends linearly at the portion thereof which is on the side of an outer circumference of the rocker arm in the direction in which the oil supply passage crosses the cam shaft at right angles thereto, and increases in the sectional area of the flow passage thereof at the portion thereof which is on the side of the roller toward the side of the roller as the oil supply passage extends toward the rocker arm support member.

(3) According to still another aspect of the present invention, the present invention provides a valve operating system for internal combustion engines having a rocker arm support member provided with an oil passage in an inner portion thereof, a cam shaft provided with a valve operating cam thereon, a roller shaft provided on an outer circumference thereof with a roller contacting the valve operating cam via a needle bearing while rolling, and a rocker arm provided with first and second support wall portions mutually spaced each other and opposed to each other, the first support wall portion having a bottomed portion-carrying engagement bore, the roller shaft being inserted in the engagement bore, the rocker arm being provided in an inner portion thereof with an oil supply passage for supplying a lubricating oil from the rocker arm support member to the engagement bore, wherein the valve operating system is characterized by that a clearance is provided between the end portion of the roller shaft which is most distant from the rocker arm support member and the bottomed portion.

(4) According to a further aspect of the present invention, the present invention provides a valve operating system for internal combustion engines in accordance with the third invention (3) above, in which the roller shaft is fixed to the second support wall portion by a snap ring, the width of the clearance being larger than that of the snap ring.

(5) According to another aspect of the present invention, the present invention provides a valve operating system for internal combustion engines in accordance with any of the first to fourth inventions (1) to (4) above, in which the rocker arm is manufactured by a lost wax process.

(6) According to a further aspect of the present invention, the present invention provides a valve operating system for internal combustion engines in accordance with the above (1) or (2), wherein the rocker arm is manufactured by a lost wax process.

(7) According to a further aspect of the present invention, the present invention provides a valve operating system for internal combustion engines in accordance with the above (3) or (4), wherein the rocker arm is manufactured by a lost wax process.

BRIEF DESCRIPTION OF THE DRAWINGS

A preferred embodiment of the present invention will be described in detail with reference to the following figures, wherein.

DESCRIPTION OF SYMBOLS

Figure 1:
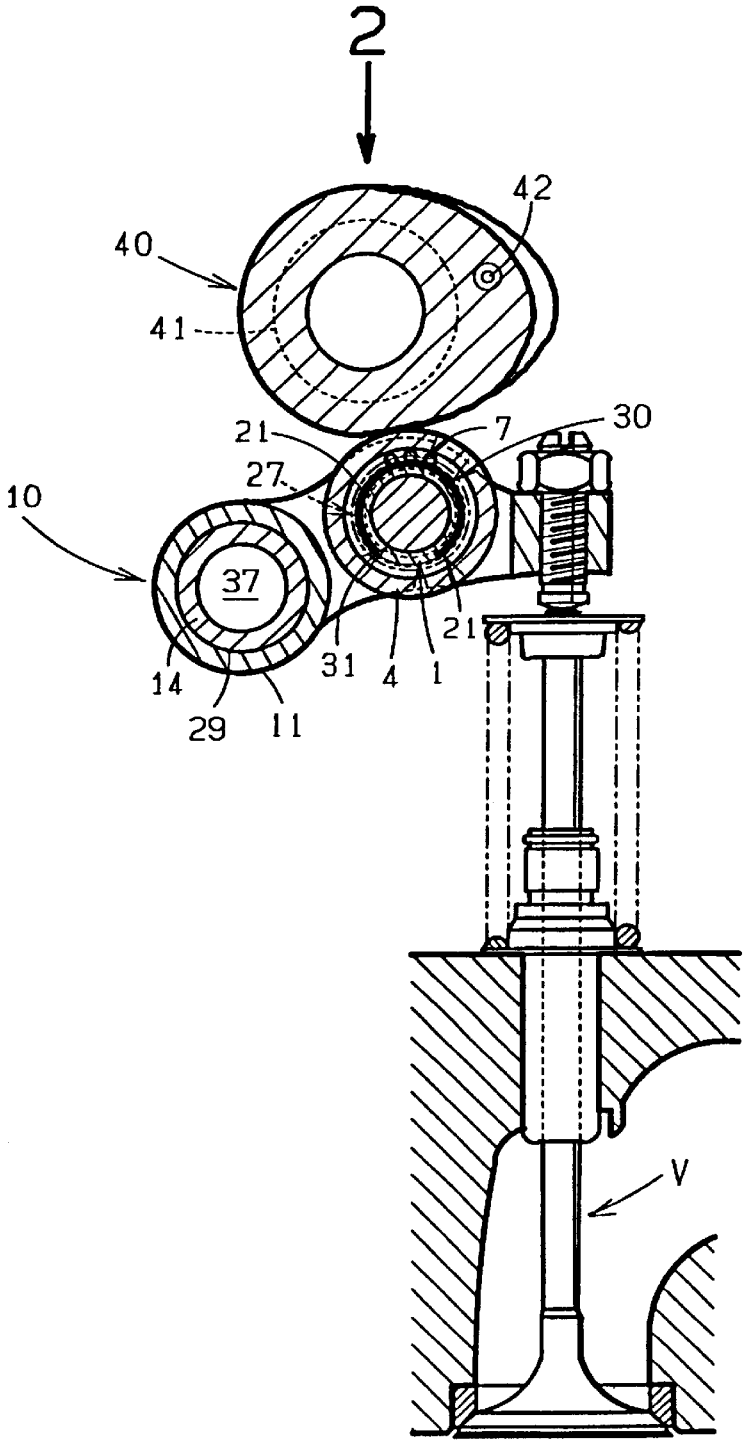
FIG. 1 is a longitudinal sectional view showing a first driving rocker arm member in an embodiment and also a cross sectional view taken along the line 1—1 in FIG. 2.

1 . . . roller shaft
4 . . . roller
7 . . . needle bearing
10 . . . connected rocker arm
11,12,13 . . . rocker arm
14 . . . rocker arm support member
$15_1$ . . . first wall portion
$15_2$ . . . second wall portion
18 . . . roller-side opening
21 . . . snap ring setting groove(in engagement bore)
$24_1$ . . . first engagement bore
$24_2$ . . . second engagement bore
27 . . . snap ring setting groove(on outer circumferential surface of the shaft)
28 . . . bottomed portion
29 . . . rocker arm support member-side opening
30 . . . snap ring
31 . . . interlocking change-over unit
32 . . . timing piston
33 . . . change-over piston
34 . . . regulating member
35 . . . return spring
36 . . . hydraulic pressure chamber
37 . . . oil passage
38 . . . oil supply port
39 . . . oil supply passage
40 . . . valve operating cam
41 . . . cam shaft
42 . . . low-speed valve operating cam
43 . . . oil port
44 . . . outer wall
V . . . valve

DESCRIPTION OF THE PREFERRED EMBODIMENT

Figure 2:
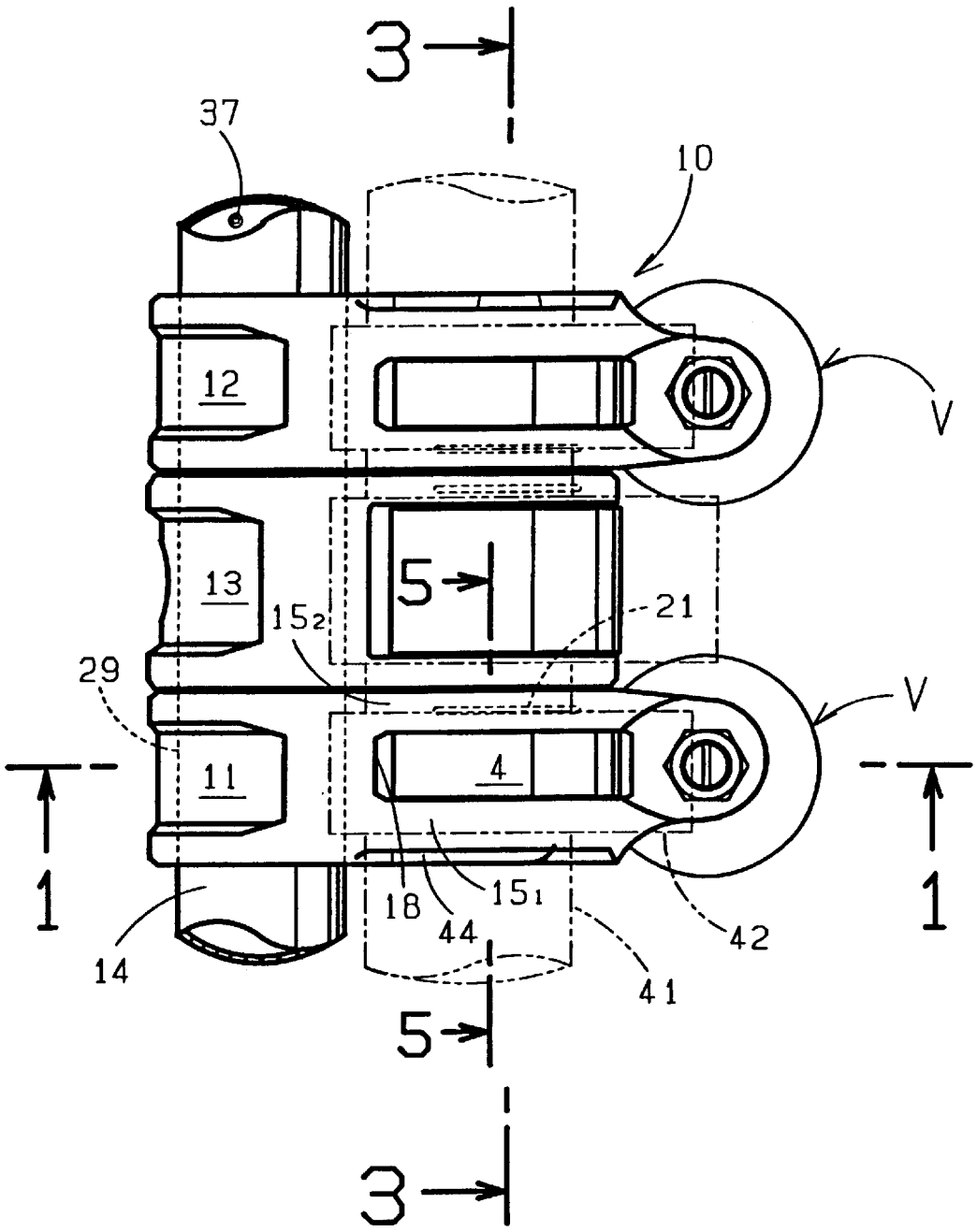
FIG. 2 is a plan view taken in the direction of an arrow 2 in FIG. 1.
Figure 3:
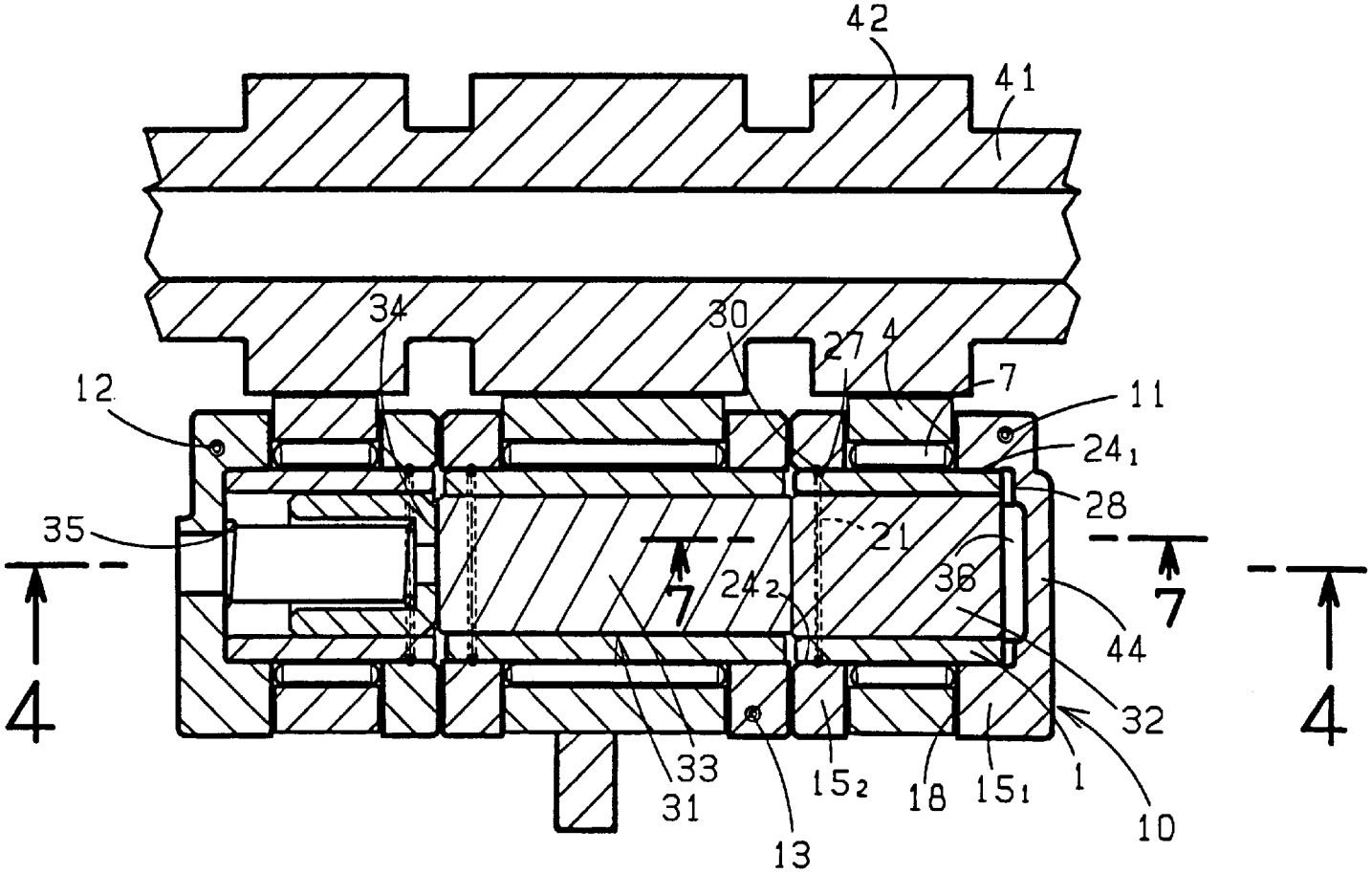
FIG. 3 is a sectional view taken along the line 3—3 in FIG. 2.
Figure 4:
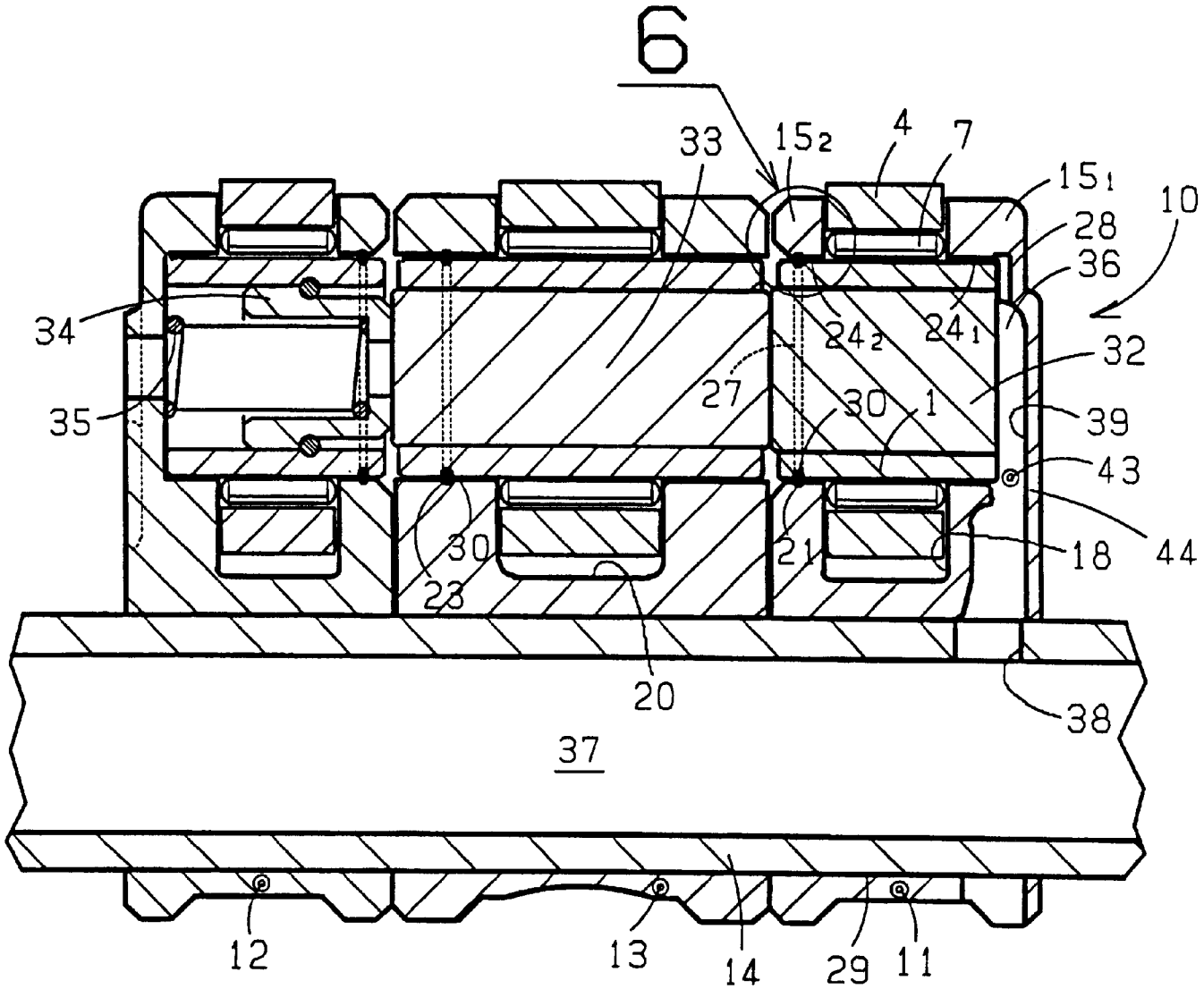
FIG. 4 is a sectional view taken along the line 4—4 in FIG. 3.
Figure 5:
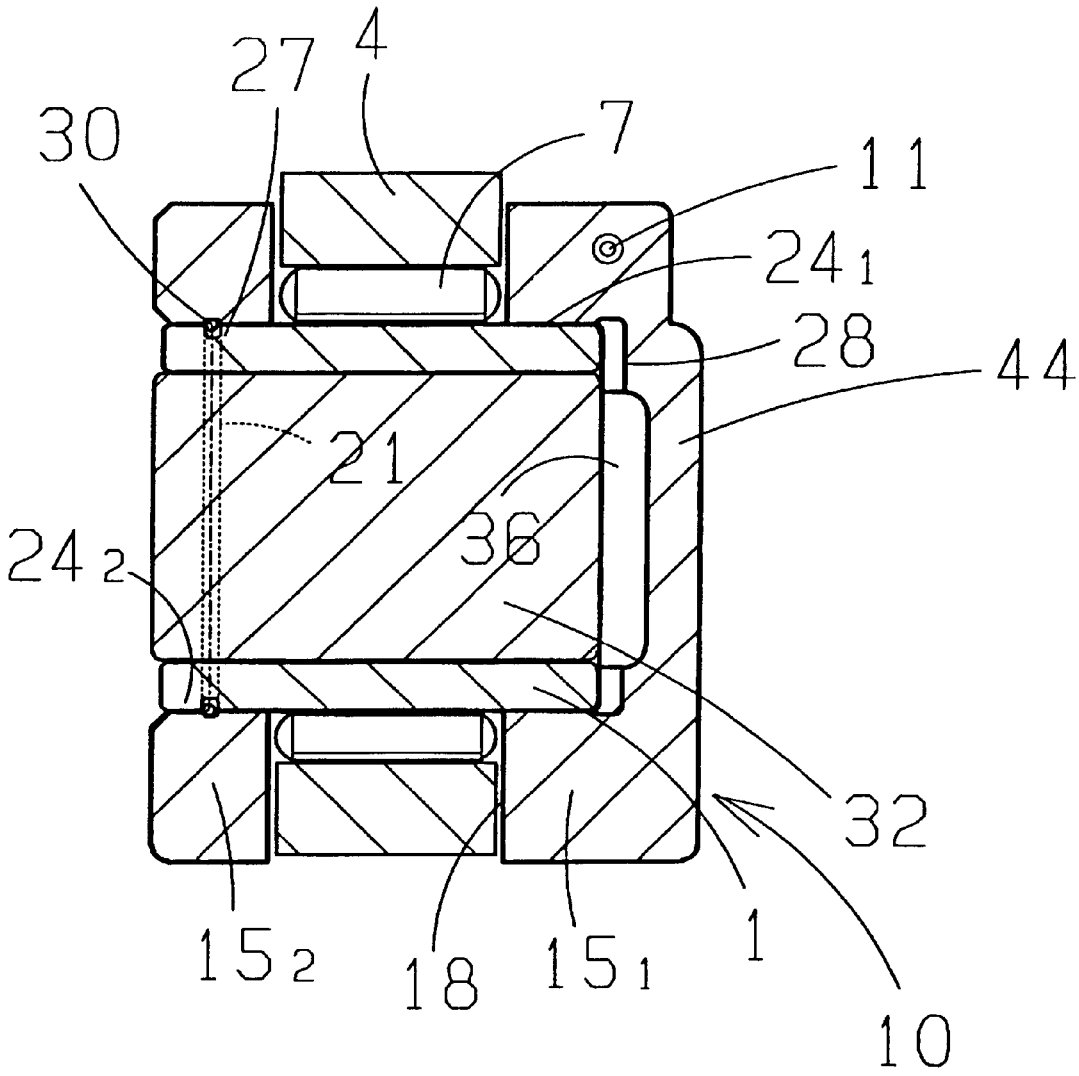
FIG. 5 is a sectional view taken along the line 5—5 in FIG. 2.
Figure 6:
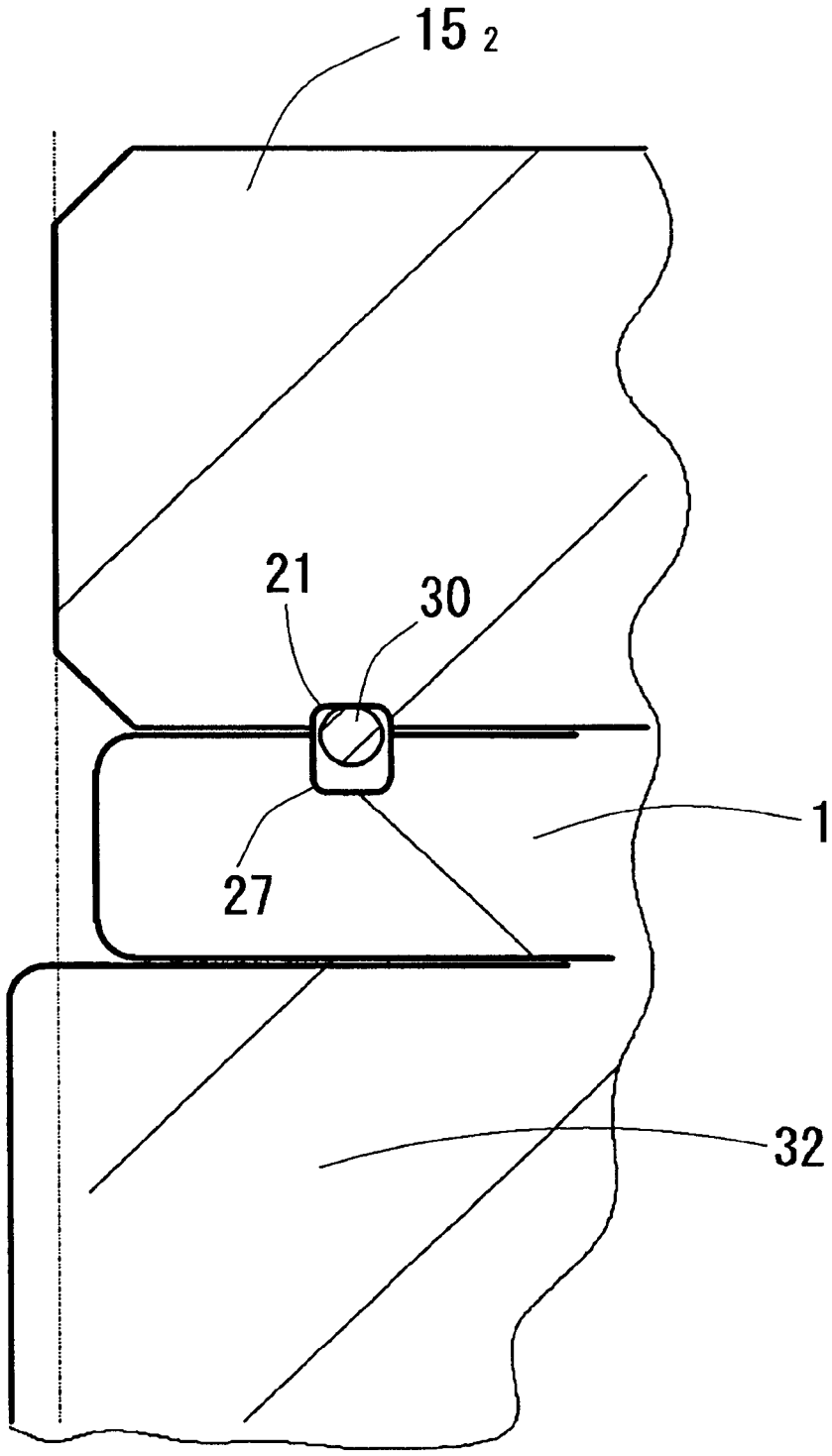
FIG. 6 is a partial enlarged view of a designated portion 6 in FIG. 4.
Figure 7:
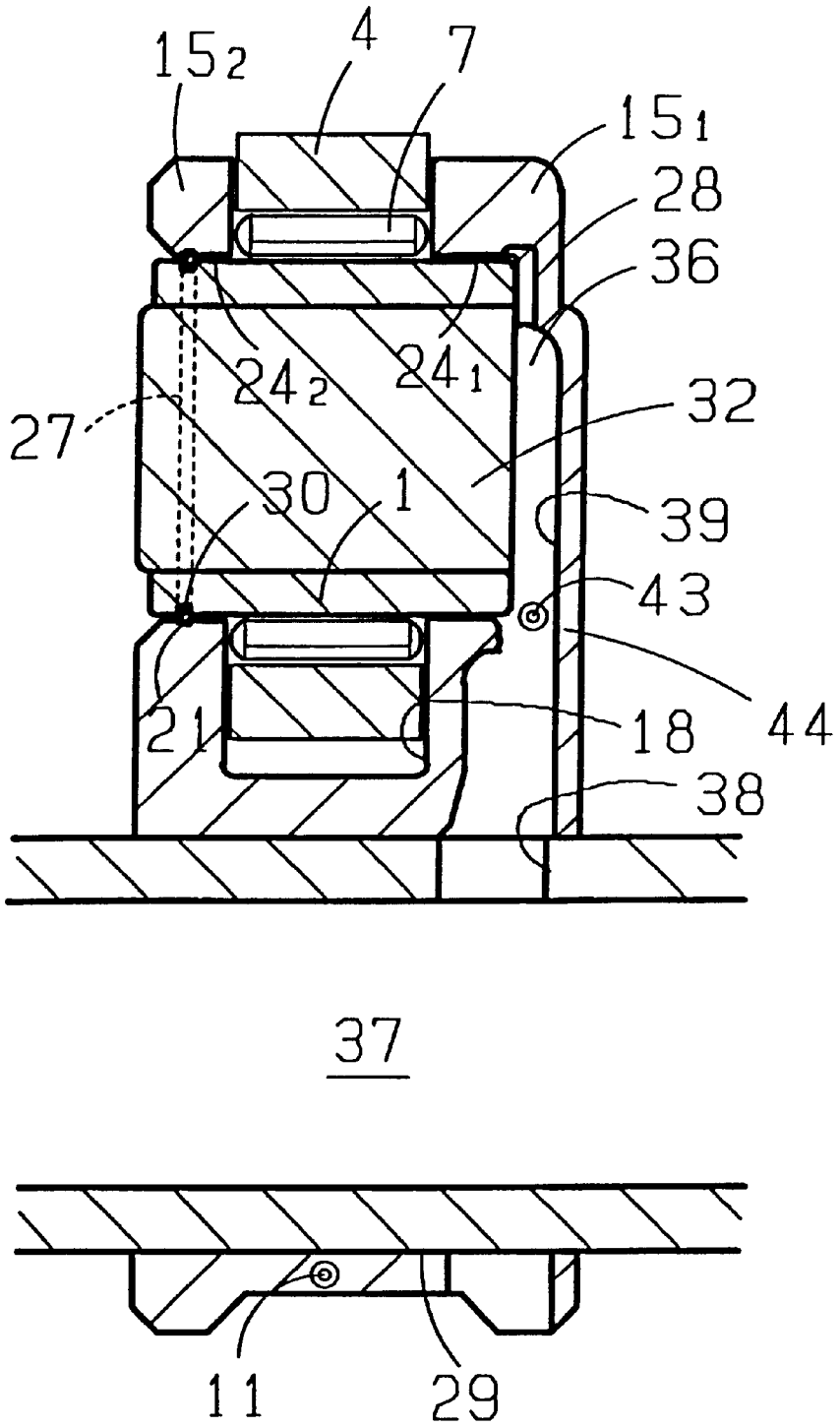
FIG. 7 is a sectional view taken along the line 7—7 in FIG. 3.

A mode of embodiment of the present invention will now be described on the basis of what are illustrated in the attached drawings. FIGS. 1–7 show an embodiment of the present invention, in which FIG. 1 is a longitudinal sectional view showing a first driving rocker arm member 11 and taken along the line 1—1 in FIG. 2; FIG. 2 a plan view taken in the direction of an arrow 2 in FIG. 1; FIG. 3 a sectional view taken along the line 3—3 in FIG. 2; FIG. 4 a sectional view taken along the line 4—4 in FIG. 3; FIG. 5 a sectional view taken along the line 5—5 in FIG. 2; FIG. 6 a partial enlarged view of a designated portion 6 in FIG. 4; and FIG. 7 is a sectional view taken along the line 7—7 in FIG. 3.

First, referring to FIG. 1, a cylindrical roller shaft is provided, for example, in a portion 1. A roller 4 rolling contacting a valve operating cam 40 is supported around the roller shaft 1 via a needle bearing 7 so that the roller can be turned.

Referring to FIGS. 2–4 collectively, a rocker arm 10 is connected to a pair of valve units V, V. The continuously connected rocker arm 10 is provided with a first driving rocker arm member 11 operatively connected to one of the two valve units V, V, a second driving rocker arm member 12 operatively connected to the other of the two valve units V, V, and a free rocker arm member 13 capable of becoming free with respect to the two valve units V, V. This rocker arm 10 is driven by a cam shaft 41 operatively connected to a crankshaft (not shown). The first driving rocker arm member 11, second driving rocker arm member 12 and free rocker arm member 13 are arranged in a mutually adjacent relation so that the free rocker arm member 13 is sandwiched between the first and second driving rocker arm members 11, 12. The rocker arm members are supported in common on a rocker arm support member 14, which is inserted through rocker arm support member-side openings 29 provided in the rocker arm members, so that the rocker arm members can be swinged and can work.

The first driving rocker arm member 11 is provided with a vertically opened roller-side opening 18 so that mutually opposed first and second support wall portions $15_1$, $15_2$ extending perpendicularly to the axis of the rocker arm support member 14 are formed on both sides of the first driving rocker arm member 11. A cylindrical roller 4 rolling contacting a low-speed valve operating cam 42 is supported on the cylindrical roller shaft 1 via the needle bearing 7 so that the roller 4 is disposed in the roller-side opening 18 is rotatably supported and can be turned freely with respect to the first driving rocker arm member 11. The first support wall portion 151 is provided with a bottomed first engagement bore $24_1$, which is opened at the side of the free rocker arm member 13, in such a manner that this engagement bore extends in parallel with the axis of the rocker arm support member 14, while the second support wall portion $15_2$ is provided with a both-end-opened second engagement bore $24_2$ so that this engagement bore is coaxial with the first engagement bore $24_1$. Referring to the mentioned drawings and FIG. 5 as well, the cylindrical roller shaft 1 is fitted in the first engagement bore $24_1$ so as to provide a clearance between a bottomed portion 28 of this bore and the end portion of the roller shaft 1 which is most distant from the rocker arm support member 14 so that the roller shaft 1 does not contact the bottomed portion 28. In the second engagement bore $24_2$, a snap ring 30 is fitted in a snap ring setting groove 21 provided in the second support wall portion $15_2$ and a snap ring setting groove 27 provided in an outer circumferential surface of the other end side portion of the roller shaft 1, the roller shaft 1 being thereby retained in the first driving rocker arm member 11. The width of the clearance mentioned above is kept larger than that of the snap ring setting groove 21. Referring to the mentioned drawings and FIG. 6 as well, the second-mentioned end portion of the roller shaft 1 fitted in the second engagement bore $24_2$ is retained in a position on the inner side of the outer side surface of the second support wall portion $15_2$ which is adjacent to the free rocker arm member 13.

An interlocking change-over unit 31 is provided with a timing piston 32 serving as a sliding member capable of switching an interlocking mode and an interlocking cancellation mode of the mutually adjacent first driving rocker arm member 11 and free rocker arm member 13 from one to the other and vice versa, a change-over piston 33 serving as a sliding member capable of switching an interlocking mode and an interlocking cancellation mode of the mutually adjacent free rocker arm member 13 and second driving rocker arm member 12 from one to the other and vice versa, a bottomed cylindrical regulating member 34 as a sliding member contacting the change-over piston 33 at the opposite side of the timing piston 32, and a return spring 35 adapted to urge the regulating member 34 toward the change-over piston 33. This interlocking change-over unit controls an oil, which is supplied from an oil pump operated by a rotation of a crank (not shown), via a control valve (not shown).

Referring to the mentioned drawings and FIG. 7 as well, the timing piston 32 is slidably fitted around the portion of the roller shaft 1 which corresponds to the first driving rocker arm member 11, and a hydraulic pressure chamber 36 is defined by a closed end of the first engagement bore $24_1$ in which the first-mentioned end portion of the roller shaft 1 is fitted and a corresponding end of the timing piston 32. In the rocker arm support member 14, an oil passage 37 connected to a hydraulic pressure source via a control valve (not shown) is provided, for example, coaxially with the rocker arm support member 14, and the rocker arm support member 14 is provided with an oil supply port 38 so that an oil supply passage 39 provided in the first support wall portion $15_1$ of the first driving rocker arm member 11 is constantly communicated with the oil passage 37. The oil supply passage 39 is connected at one end thereof with the hydraulic pressure chamber 36 and forms a part of an outer wall 44. The oil entering the first driving rocker arm member 11 has flowed from the oil passage 37 via an oil supply port 38 and the oil supply passage 39 in the mentioned order. The sectional area of the flow passage of the oil supply passage 39 through which a lubricating oil is supplied to the roller 4 increases gradually from the roller-side opening 18 toward a rocker arm support member-side opening 29. In other words, the oil supply passage is formed so that the sectional area thereof increases gradually from an oil port 43 toward the oil supply port 38. The characteristic feature of the present invention is shown for example by the FIG. 4. The sectional area or square measure of the oil supply passage at the oil supply port 38 relative to the sectional area or square measure of oil supply passage at the oil port 43 is changeable according to the position of the roller-side opening 18, but it is generally 1: (1.21 to 9), preferably 1:(1.44 to 7.16) in terms of the ratio of the both sectional areas of square measures given by the following equation.

Sectional area of oil supply passage at the oil supply port 38 Sectional area of oil supply passage at the oil port 43

The oil supply passage extends linearly at the side of an outer circumference of the rocker arm in the direction in which this passage crosses the cam shaft at right angles thereto, and in such a manner at the side of the roller that the sectional area of the flow passage thereof increases toward the roller, i.e., toward the rocker arm support member. This enables the sectional area of the flow passage to be increased without increasing the dimensions or volume of the rocker arm. When the rocker arm support member is a rocker shaft, the rigidity of an outer end portion thereof does not lower.

The materials for manufacturing the rocker arm in the present invention include, for example, (a) alloy steel formed of C: 0.13 to 0.18%, Si: 0.30 to 0.60%, Mn: 0.60 to 0.85%, P: 0 to 0.030%, S: 0 to 0.030%, Cr: 0.90 to 1.20%, Mo: 0.10 to 0.25%, Ni: 0 to 0.25%, Cu: 0 to 0.30%, and the remainder: Fe and unavoidable impurities, (b) a steel material of chromium-molybdenum steel other than (a)(SCM415, SCM418, SCM420, SCM421, SCM430, SCM432, SCM435, SCM440, SCM445, SCM832, etc.), (c) a steel material of nickel-chromium-molybdenum steel (SNCM220, SNCM240, SNCM415, SNCM420, SNCM431, SNCM439, SNCM447, SNCM616, SNCM625, SNCM630, SNCM815, etc.), (d) a steel material of chromium steel (SCr415, SCr420, SCr430, SCr435, SCr440, SCr445, etc.), and (e) a steel material of aluminum-chromium-molybdenum steel (SACM645, etc.). The rocker arm in the present invention is manufactured usually by molding the above-mentioned materials by, for example, a lost wax process or a MIM process, and then subjecting the resultant product to a thermal treatment, for example, carburization or nitriding according to the well-known method.

According to the first-mentioned invention, the sectional area of the oil supply passage increases gradually from an opening thereof on the side of the roller toward an opening thereof on the side of the rocker arm support member, so that it is possible to form the rocker arm support member-side opening to a sufficiently large size, and supply a sufficient quantity of lubricating oil. Since this sectional area increases gradually, a flow resistance of the lubricating oil can be minimized, and a pressure loss can be reduced. A decrease in the rigidity of the oil supply passage can be held down as compared with that of an oil supply passage which does not have the above-mentioned feature or characteristic.

According to the second-mentioned invention, the oil supply passage extends linearly at the portion thereof which is on the side of the outer circumference of the rocker arm in the direction in which the oil supply passage crosses the cam shaft at right angles thereto, and increases in the sectional area of the flow passage at the portion thereof which is on the side of roller toward the side of the roller as the oil supply passage extends toward the rocker arm support member. Therefore, the sectional area can be increased without increasing the dimensions of the rocker arm.

According to the third-mentioned invention, a clearance is provided between the end portion of the roller shaft which is most distant from the rocker arm support member and the bottomed portion of the engagement bore, so that a lubricating oil can be supplied to even the portion of the roller which is most distant from the cam shaft.

According to the fourth-mentioned invention, the roller shaft is fixed to the second support wall portion by a snap ring with the width of the clearance set larger than that of the snap ring, this enabling the roller shaft to be fixed reliably without being influenced by a scatter of the sizes of the snap ring-fixed portion.

According to the fifth-mentioned invention, the rocker arm is manufactured by a lost wax process, the process per se being well known in the art, so that a rocker arm of even a complicated shape can be manufactured easily.

What is claimed is:

1. A valve operating system for internal combustion engines, comprising a rocker arm support member provided with an oil passage in an inner portion thereof, a cam shaft provided with a valve operating cam thereon, and a rocker arm which is provided thereon with a roller contacting the valve operating cam while rolling, and which is provided in an inner portion thereof with an oil supply passage for supplying a lubricating oil from the rocker arm support member to the roller, wherein the improvement lies in that the sectional area of a flow passage of the oil supply passage increases gradually from an opening thereof on the side of the roller toward an opening thereof on the side of the rocker arm support member.

2. A valve operating system for internal combustion engines according to claim 1, wherein the oil supply passage extends linearly at the portion thereof which is on the side of an outer circumference of the rocker arm in the direction in which the oil supply passage crosses the cam shaft at right angles thereto, and increases in the sectional area of the flow passage thereof at the portion thereof which is on the side of the roller toward the side of the same roller as the oil supply passage extends toward the rocker arm support member.

3. A valve operating system according to the claim 2, wherein the rocker arm is manufactured by a lost wax process.

4. A valve operating system according to the claim 1, wherein the rocker arm is manufactured by a lost wax process.

5. A valve operating system for internal combustion engines, comprising a rocker arm support member provided with an oil passage in an inner portion thereof, a cam shaft provided with a valve operating cam thereon, a roller shaft provided on an outer circumference thereof with a roller contacting the valve operating cam via a needle bearing while rolling, and a rocker arm provided with first and second support wall portions mutually spaced each other and opposed to each other, the first support wall portion having a bottomed portion-carrying engagement bore, the roller shaft being inserted in the engagement bore, the rocker arm being provided in an inner portion thereof with an oil supply passage for supplying a lubricating oil from the rocker arm support member to the engagement bore, wherein the improvement lies in that a clearance is provided between the end portion of the roller shaft which is most distant from the rocker arm support member and the bottomed portion.

6. A valve operating system according to claim 5, wherein the roller shaft is fixed to the second support wall portion by a snap ring, the width of the clearance being larger than that of the snap ring.

7. A valve operating system according to claim 6, wherein the rocker arm is manufactured by a lost wax process.

8. A valve operating system according to claim 5, wherein the rocker arm is manufactured by a lost wax process.

* * * * *